US010004943B2

(12) United States Patent
Ho et al.

(10) Patent No.: US 10,004,943 B2
(45) Date of Patent: Jun. 26, 2018

(54) PORTABLE ABS EXERCISE DEVICE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 44 days.

(21) Appl. No.: 14/974,569

(22) Filed: Dec. 18, 2015

(65) Prior Publication Data

US 2017/0173383 A1 Jun. 22, 2017

(51) Int. Cl.

| | |
|---|---|
| ***A63B 23/02*** | (2006.01) |
| ***A63B 21/068*** | (2006.01) |
| ***A63B 22/20*** | (2006.01) |
| ***A63B 23/035*** | (2006.01) |
| ***A63B 21/00*** | (2006.01) |
| *A63B 21/055* | (2006.01) |
| *A63B 21/06* | (2006.01) |

(Continued)

(52) U.S. Cl.

CPC ..... *A63B 23/0205* (2013.01); *A63B 21/068* (2013.01); *A63B 21/4031* (2015.10); *A63B 21/4034* (2015.10); *A63B 21/4035* (2015.10); *A63B 21/4045* (2015.10); *A63B 21/4047* (2015.10); *A63B 21/4049* (2015.10); *A63B 22/20* (2013.01); *A63B 23/0211* (2013.01); *A63B 23/0216* (2013.01); *A63B 23/03525* (2013.01); *A63B 21/0552* (2013.01); *A63B 21/0615* (2013.01); *A63B 21/4033* (2015.10); *A63B 23/0227* (2013.01); *A63B 23/0482* (2013.01); *A63B 2022/206* (2013.01); *A63B 2069/0062* (2013.01); *A63B 2071/027* (2013.01); *A63B 2208/0219* (2013.01); *A63B 2208/0233* (2013.01); *A63B 2208/0238* (2013.01); *A63B 2210/50* (2013.01); *A63B 2225/09* (2013.01)

(58) Field of Classification Search

CPC ..... A63B 23/0205; A63B 23/0211; A63B 23/0216; A63B 23/0222; A63B 23/0227

See application file for complete search history.

(56) References Cited

U.S. PATENT DOCUMENTS 2,425,860 A * 8/1947 Brady ..... B65G 41/002 198/318
3,802,701 A * 4/1974 Good, Jr. ..... A63B 21/015 482/119

(Continued)

*Primary Examiner* — Loan H Thanh
*Assistant Examiner* — Rae Fischer
(74) *Attorney, Agent, or Firm* — Womble Bond Dickinson (US) LLP

(57) ABSTRACT

An exercise device includes a base frame having a first baseboard member, a second baseboard member, and a base pad disposed in between. The first baseboard member includes a first locking member disposed on a first headend of the first baseboard member, and the second baseboard member includes a second locking member disposed on a second headend of the second baseboard member. The exercise device further includes a pole frame having a top crossbar, a bottom crossbar, a first side pole, and a second side pole. The first lock member of the first baseboard member is inserted into a cross section of the first side pole and the second lock member of the second baseboard member is inserted into a cross section of the second side pole, such that the pole frame is interlocked with the base frame substantially perpendicularly.

13 Claims, 14 Drawing Sheets

(51) Int. Cl.

| | |
|---|---|
| *A63B 23/04* | (2006.01) |
| *A63B 69/00* | (2006.01) |
| *A63B 71/02* | (2006.01) |

(56) References Cited

U.S. PATENT DOCUMENTS

| | | | | | |
|---|---|---|---|---|---|
| 5,496,243 | A | * | 3/1996 | Allen | A63B 21/0601<br>482/106 |
| 5,759,138 | A | * | 6/1998 | Boland | A63B 23/0211<br>482/122 |
| 5,810,702 | A | * | 9/1998 | Wilkinson | A63B 21/00047<br>482/130 |
| 5,931,768 | A | * | 8/1999 | Amesquita | A63B 23/0211<br>482/140 |
| 5,954,622 | A | * | 9/1999 | Olschansky | A63B 21/4015<br>482/123 |
| 7,235,040 | B2 | | 6/2007 | Chung-Ting | |

* cited by examiner

PORTABLE ABS EXERCISE DEVICE

FIELD OF THE INVENTION

Embodiments of the present invention relate generally to physical training machines, and in particular, to exercise machines commonly referred to a portable Abs exercise device that can be used on the floor or a raised platform.

BACKGROUND

Whereas people today are more conscious of fitness thanks to the ever-improved living standard, fitness equipment has become very popular. However, some of the fitness equipment emphasizing sit up in bear hands may get too rough and violent resulting in stretch in larger angles that causes injuries to the user having overweighed problem or in middle ages or elder. Furthermore, the sit up may become so monotonous and the user may be disinterested very quickly. Besides, fitness equipment generally available in the market either consumes too much space at home or is very expensive, plus other factors, such as the users in a family whose age, physical strength vary, the confined space available at home, the limit to only one function, and nature and length of training session.

Abs exercise apparatuses commonly feature a standing frame, which requires a significant amount of storage space. Even when folded, the exercise apparatus with a changed length may still be bulky in size, occupying too much space for storage or during delivery. Thus, the conventional Abs exercise apparatuses require further improvements.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Figure 1:
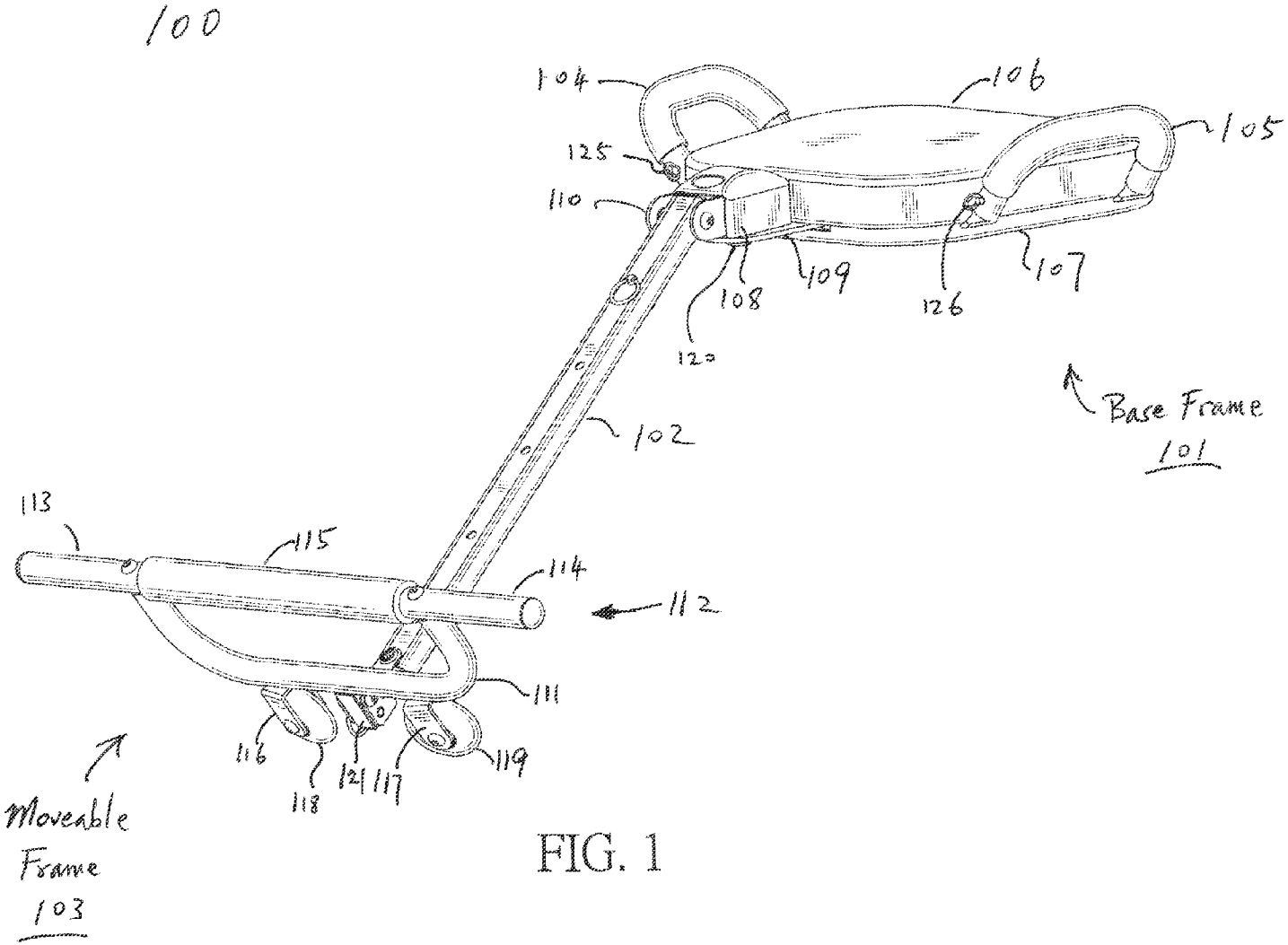
FIG. 1 shows a perspective view of an exercise device according to one embodiment of the invention.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

According to some embodiments, a portable Abs exercise device includes a base frame, a moveable frame and an elongate member coupling the base frame and the moveable frame, such that the moveable frame can swing vertically, while swinging horizontally with respect to the base frame. The base frame can be placed on a floor together with the moveable frame in a flat configuration, when the elongate member is positioned in a substantially horizontally. In the flat configuration, the moveable frame can swing left and right with respect to the base frame, while the moveable frame and the base frame are supported by a relatively flat surface. Alternatively, the base frame can be placed on a raised platform, such as, a bench, a table, a couch, etc. to allow a user to site on a base pad of the base frame, while place at least one of the user's feet downwardly on the moveable frame that is positioned at a level lower than the base frame.

In one embodiment, the base frame further includes a pair of handles to allow the user to hold or grab onto the handles while twist the legs of the user on the moveable frame to wing left and right horizontally. Alternatively, the user can knee on the base pad, while holding onto a lateral bar of the moveable frame to wing the moveable frame left and right horizontally. The base frame may further include a first pair of hooks while the moveable frame may include a second pair of hooks to connect a pair of elastic cord members or bands to provide additional resistance when the moveable frame swings vertically and/or horizontally with respect to the base frame. The moveable frame further includes one or more wheels loosely mounted at a bottom of the moveable frame to provide support and a smooth transaction when the moveable frame is placed on a relatively flat surface and swings left and right horizontally. The direction of the wheels can be automatically changed in response to a movement or swing direction of the moveable frame with respect to the base frame.

In a particular embodiment, an exercise device includes a base frame having a base plate, a base pad mounted on the base plate, a first handle mounted on a first side of the base plate, and a second handle mounted on a second side of the base plate. The base frame further includes a first mounting bracket mounted on a mounting plate extended from the base plate via a first hinge to allow the first mounting bracket to swing horizontally with respect to the mounting plate. The exercise device further includes a movable frame having a second mounting bracket mounted disposed thereon, and an elongate member coupling the base frame and the moveable frame. The elongate member includes a first end rotatably coupled to the first mounting bracket of the base frame via a second hinge to allow the elongate member to swing vertically with respect to the base plate. The elongate member further includes a second end fixedly coupled to the second mounting bracket of the moveable frame to allow the moveable frame to swing horizontally with respect to the base frame via the first hinge, while swinging vertically with respect to the base frame via the second hinge.

FIG. 1 shows a perspective view of an exercise device according to one embodiment of the invention. Referring to FIG. 1, exercise device 100 includes base frame 101, moveable frame 103 coupled to each over via an elongate member 102. Elongate member 102 includes a first end (also referred to as a near end) coupled to or mounted on a first mounting bracket 108 of baes frame 101 via a first hinge 110 (e.g., a horizontal hinge) so that elongate member 102 can swing or tilt vertically (e.g., upwardly and downwardly) with respect to base frame 101. Elongate member 102 further includes a second end (also referred to as a far end) coupled to (e.g., fixedly) mounted to a second mounting bracket 121 of moveable frame 103.

In one embodiment, base frame 101 includes a base pad 106 mounted on a base plate 107, a first handle 104 mounted on a first side of base plate 107, and a second handle 105 mounted on a second side of base plate 107. The hands of a user can hold onto handles 104-105 while sitting on base pad 106 for providing additional strength and safety measures.

Figure 7:
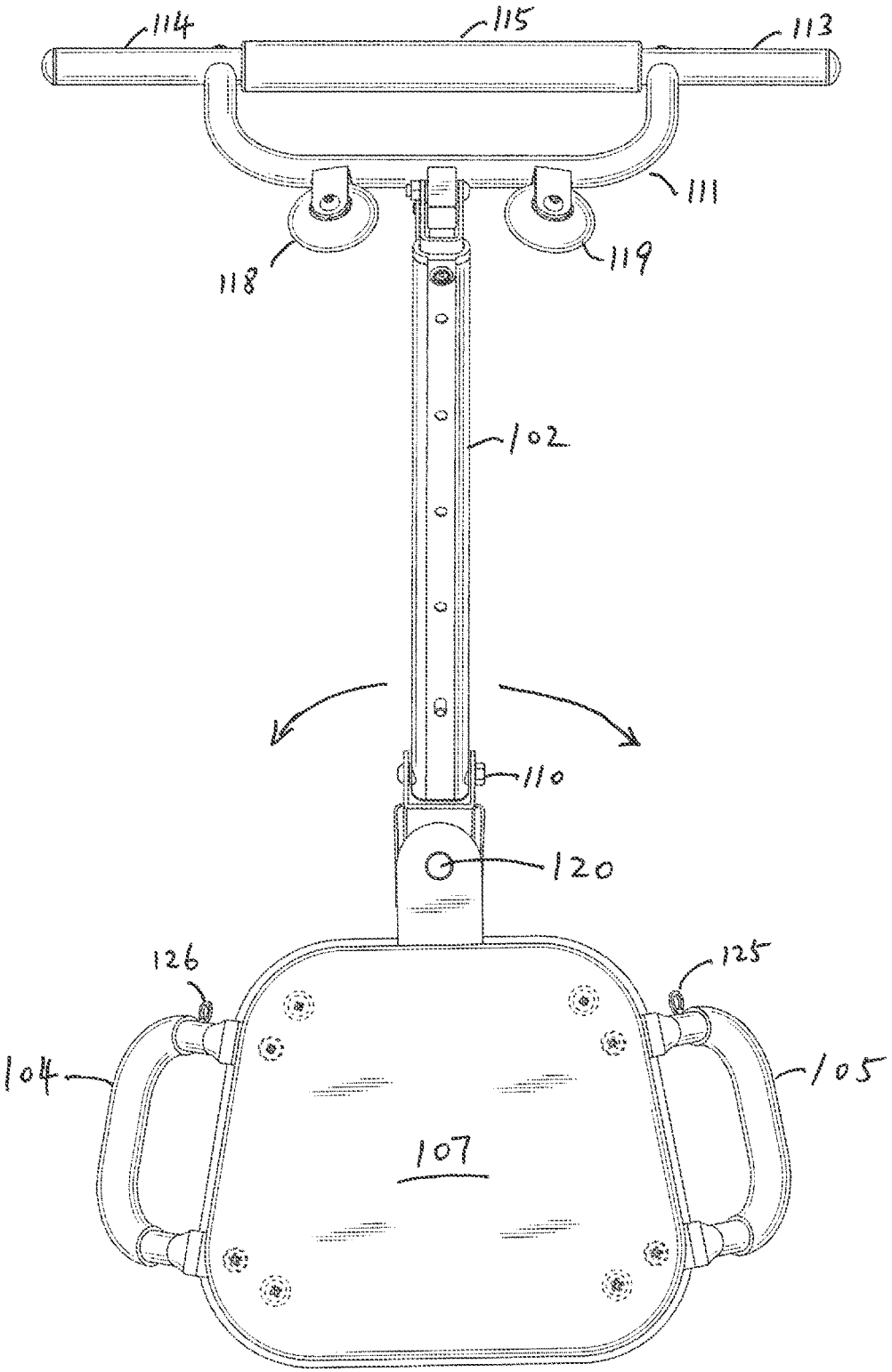
FIG. 7 shows a bottom view of an exercise device according to one embodiment of the invention.
Figure 8A:
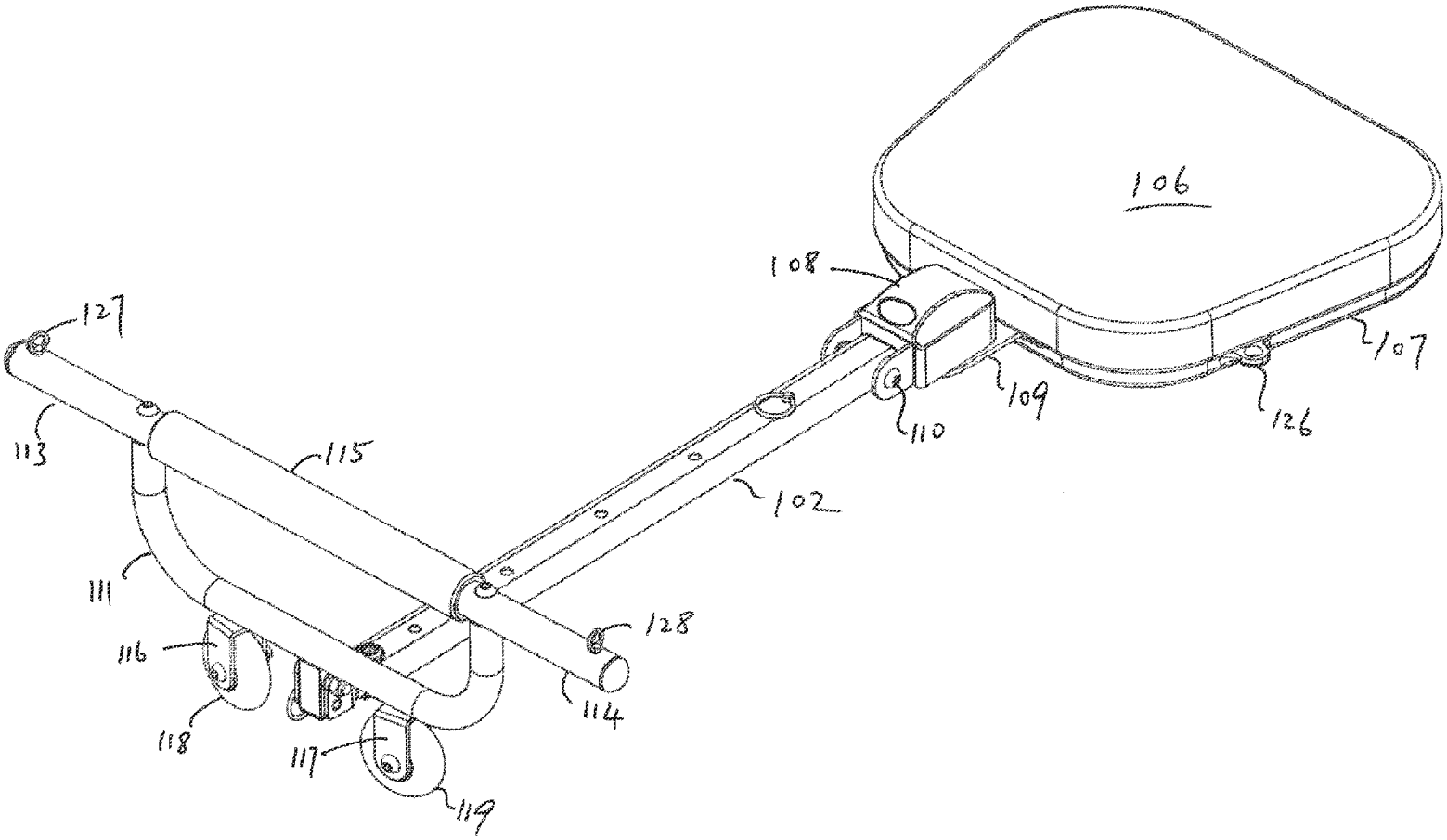
FIGS. 8A-8C show a perspective view of an exercise device according to some embodiments of the invention.

Base plate 107 further includes a mounting plate 109 extended outwardly to allowing mounting bracket 108 to rotatably mounted on mounting plate 109 via a second hinge 120. In this embodiment, first hinge 110 allows elongate member 102 to swing vertically with respect to base plate 107, while second hinge 120 allows elongate member 102 together with mounting bracket 108 to swing horizontally with respect to base plate 107, as shown in side views of FIGS. 4-5 and a bottom view of FIG. 7. Hinge 110 allows elongate member 102 and base frame 101, as well as moveable frame 103 to be a substantially flat configuration, such as the configuration as shown in FIG. 8A. In one embodiment, moveable frame 103 can also be laid flat with respect to elongate member 102 via a hinge. In such a configuration, exercise device 100 can take less space for storage, such as, for example, underneath a couch or bed, etc.

Figure 10A:
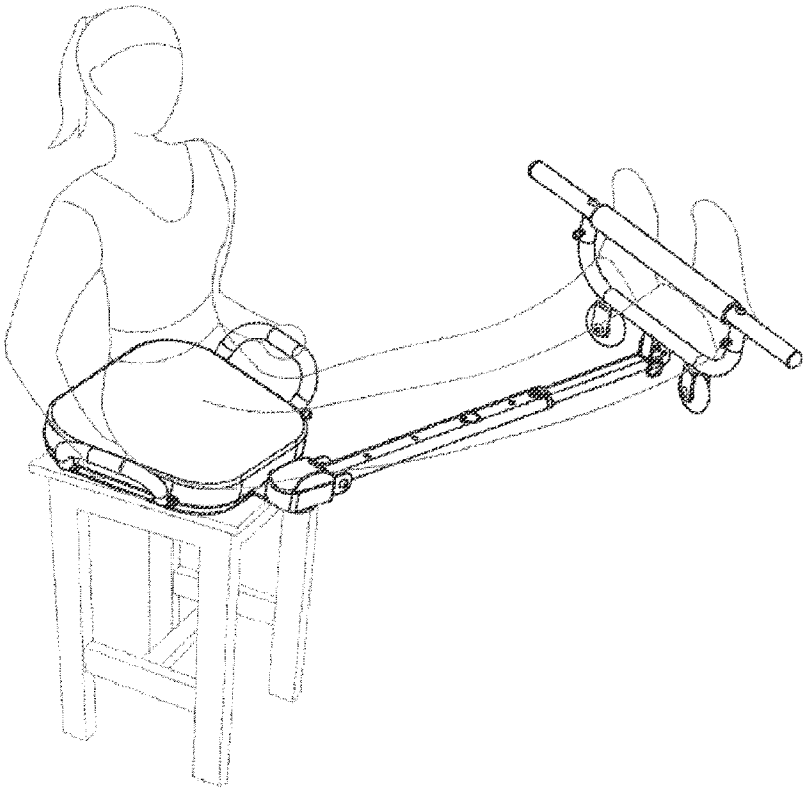
FIGS. 10A-10C show usage of an exercise device according to some embodiments of the invention.
Figure 10A:
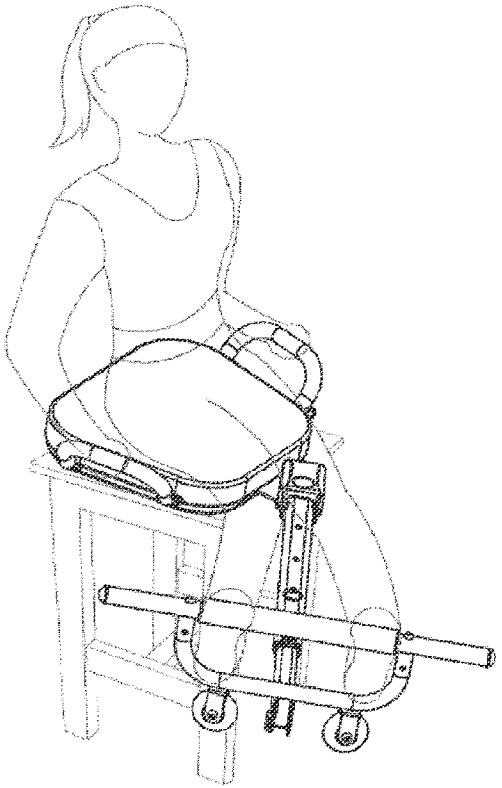
Figure 10B:
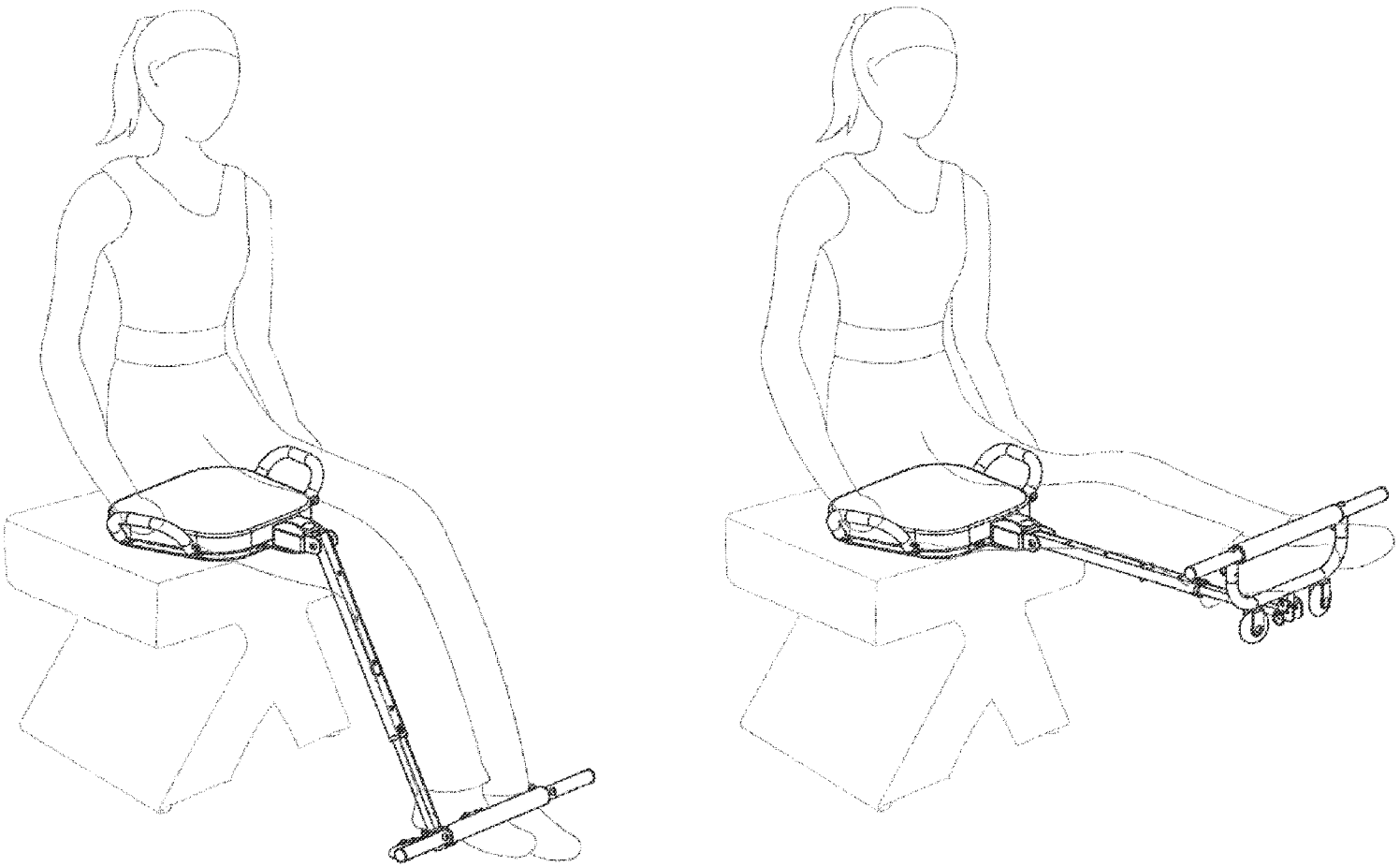
Figure 10C:
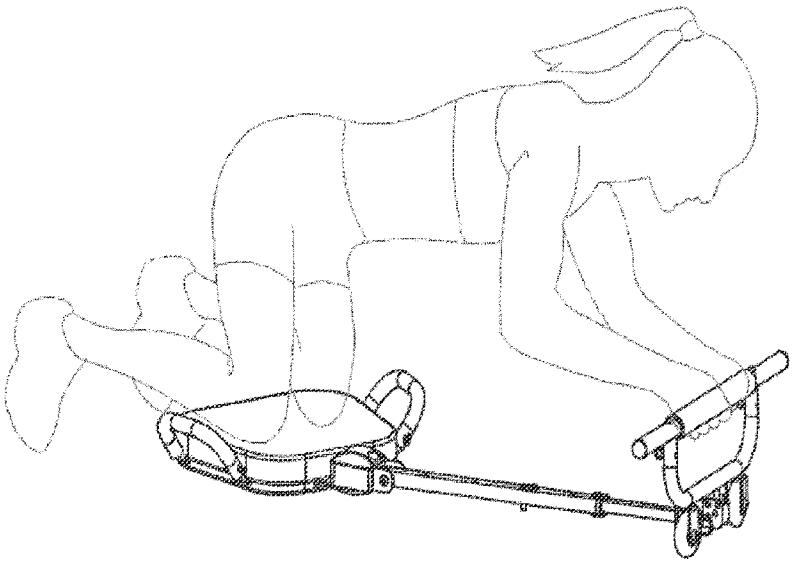
Figure 10C:
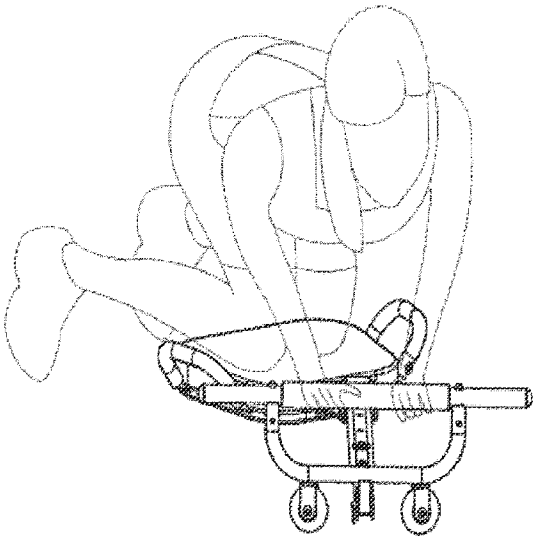

In one embodiment, moveable frame 103 includes a lateral bar 112 and a U-shape support bar 111 coupled to each other. The ends of U-shape bar 111 may be counted on lateral bar 112 using a pair of screws, which forms a first end section 113, a second end section 114, and a center section 115. Center section 115 may be covered or enclosed by a soft material such as foam. The length of center section 115 is long enough such that both feet of a user can insert into an opening between U-shape bar 111 and center section 115, while the user sits on base pad 106 of base frame 101. Alternatively, any of the feet of the user can rest or hook onto any one of end sections 113-114 while sitting on base pad 106. Examples of usage of exercise device 100 are shown in FIGS. 10A-10B. By sitting on base pad 106, a user can exercise its Abs by moving its feet placed on moveable frame 103 up and down and/or left and right. Alternatively, according to an alternative embodiment, a user can knee on base pad while its handles can grab on any of end sections 113-114 and center section 115, as shown in FIG. 10C.

Figure 2:
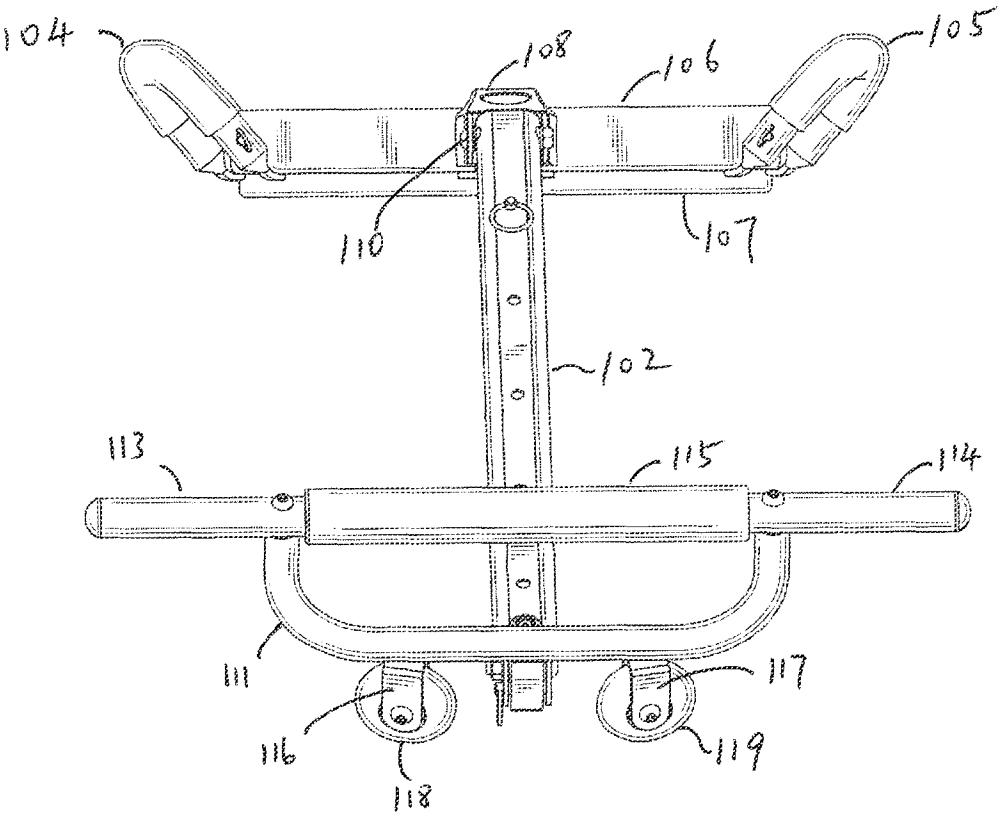
FIG. 2 shows a front view of an exercise device according to one embodiment of the invention.
Figure 3:
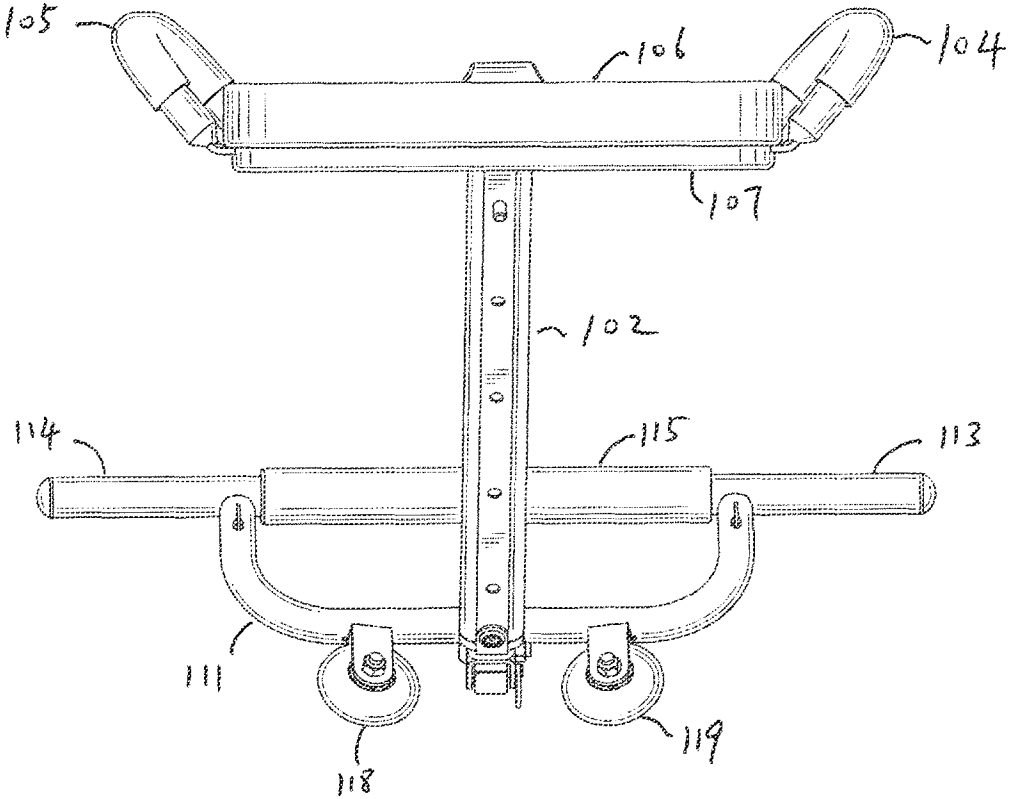
FIG. 3 shows a rear view of an exercise device according to one embodiment of the invention.
Figure 4:
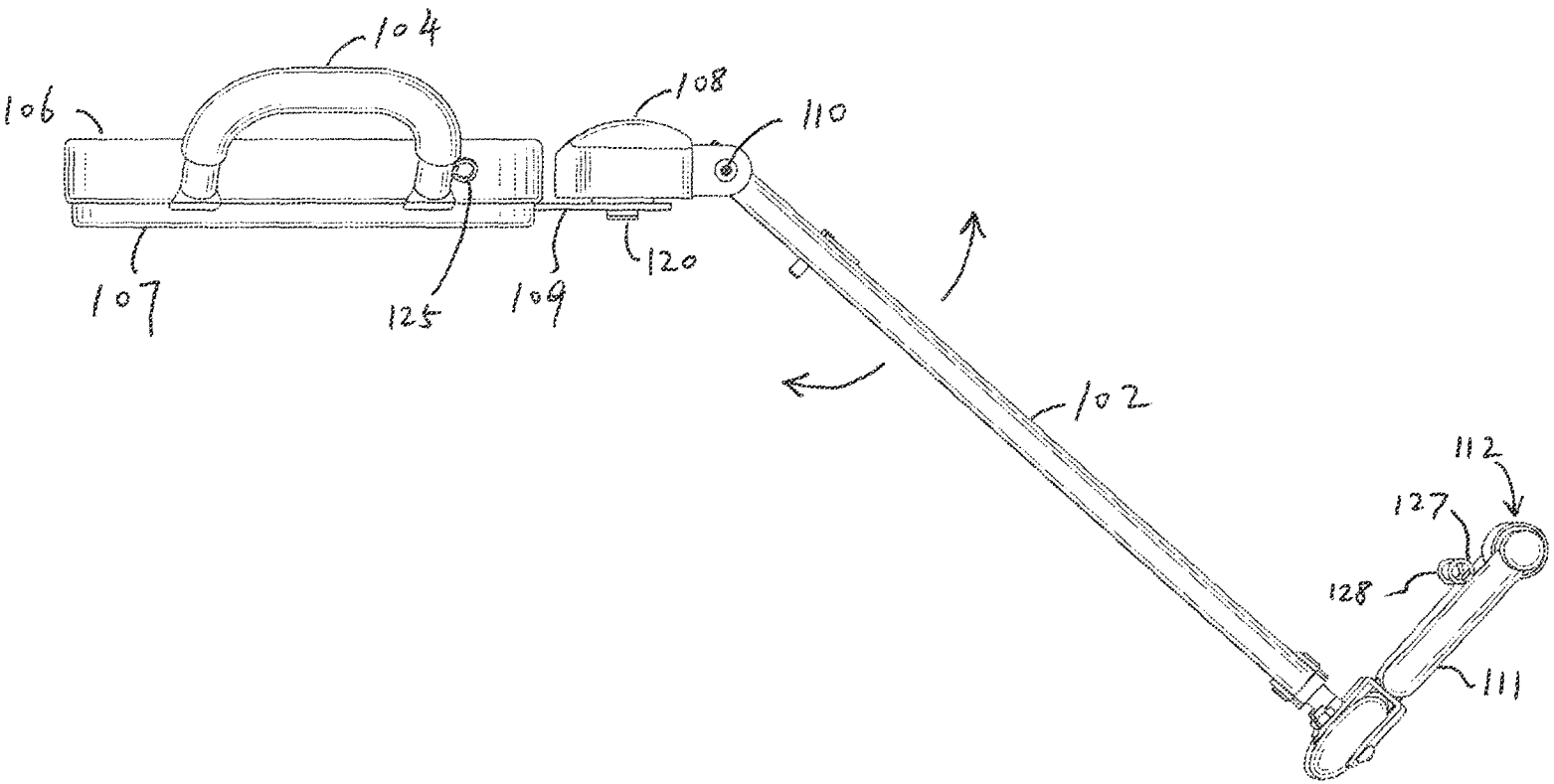
FIGS. 4-5 show side views of an exercise device according to one embodiment of the invention.
Figure 5:
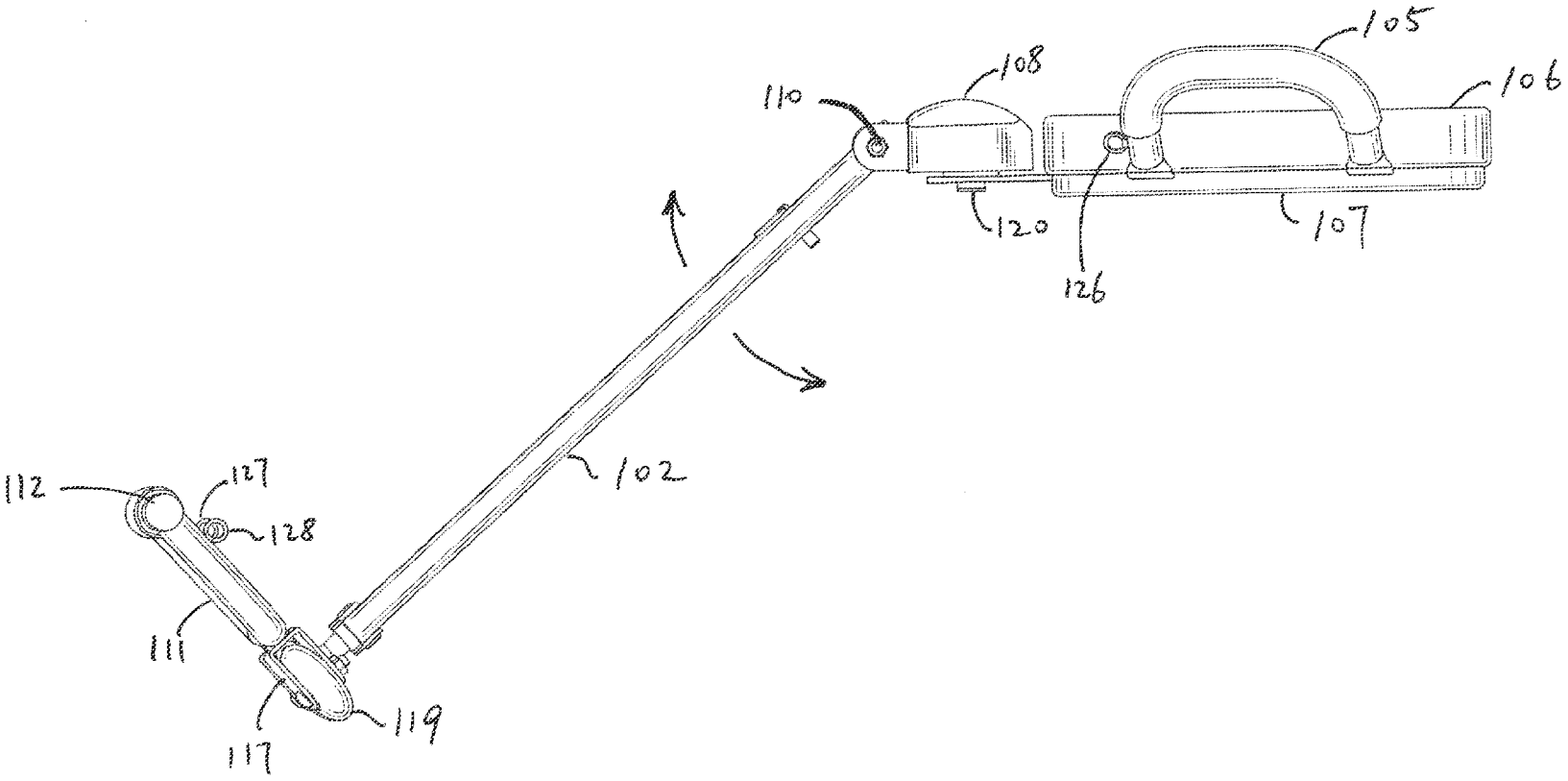
Figure 6:
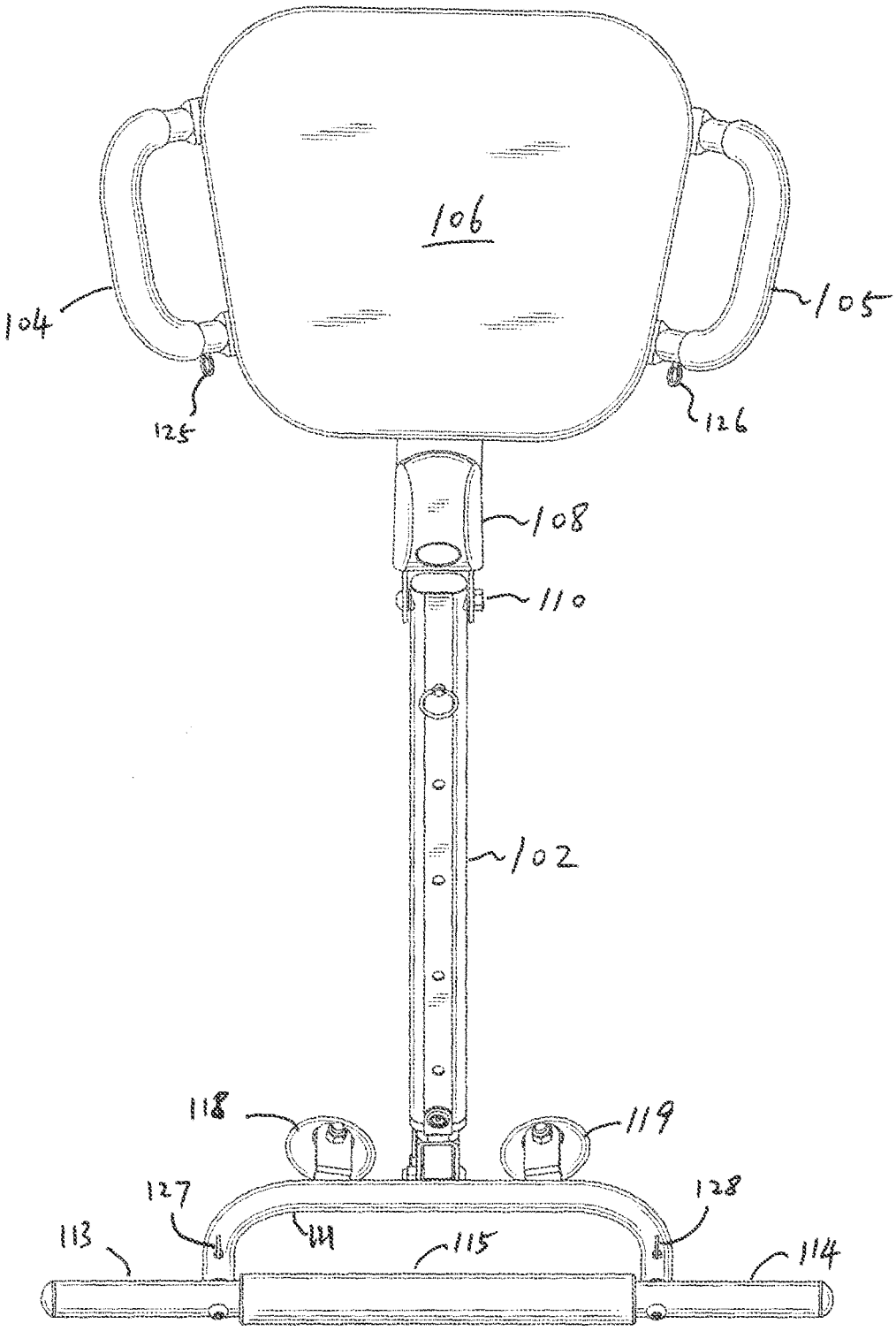
FIG. 6 shows a top view of an exercise device according to one embodiment of the invention.

Note that base frame 101 can be placed on a flat structure or surface (as shown in FIGS. 8A-8C and 10C) and alternatively, base frame 101 can be placed on a raised platform such as a bench, a couch, or a table (as shown in FIGS. 10A-10B). When base frame 101 is paced on a raised platform as shown in FIGS. 10A-10B, a user can sit on base pad 106, while placing any of its feet on moveable frame 103 outwardly and downwardly. In such a configuration, a moveable frame 103 is positioned at a level lower than base frame 101. FIG. 2 shows a front view of exercise device 100 and FIG. 3 shows a rear view of exercise device 100. FIGS. 4-5 show side views of exercise device 100. FIG. 6 shows a top view of exercise device 100 and FIG. 7 shows a bottom view of exercise device 100. FIG. 9 is an explosive view of exercise device 100.

Referring to FIGS. 1 and 4-6, in one embodiment, handle 104 includes hook 125 disposed thereon and handle 105 includes hook 126 disposed thereon. Similarly, moveable frame 103 include hooks 127-128 disposed thereon, in this example, on U-shape bar 111. Hooks 125 and 127 can be used to connect a first elastic cord member or elastic band (not shown) and hooks 126 and 128 can be used to connect a second elastic cord member or elastic band (not shown) to provide additional resistance when moveable frame 103 swings vertically and/or horizontally with respect to base frame 101. FIG. 8A shows an alternative configuration, in which handles 104-105 can be detached from the base frame and hooks are mounted on the base plate and the end sections of the lateral bar.

According to one embodiment, exercise device 100 includes a first wheel 118 mounted on a first wheel mounting bracket 116 and a second wheel 119 mounted on a second wheel mounting bracket 117. Each of wheel mounting brackets 116-117 may be formed in a U-shape to mount the corresponding wheel therein. Wheels 118-119 are configured to provide support and a smooth transaction on a support surface (e.g., floor), when moveable frame 103 swings horizontally with respect to base frame 101, as shown in FIGS. 8A-8C and 10C. In one embodiment, each of wheel mounting brackets 116-117 is loosely mounted on U-shape bar 111 via a screw, such that a moving direction of wheels 118-119 can adaptively change in response to swinging of moveable frame 103. Note that although there are wheels 118-119 are shown, more or fewer wheels may be implemented.

Figure 8B:
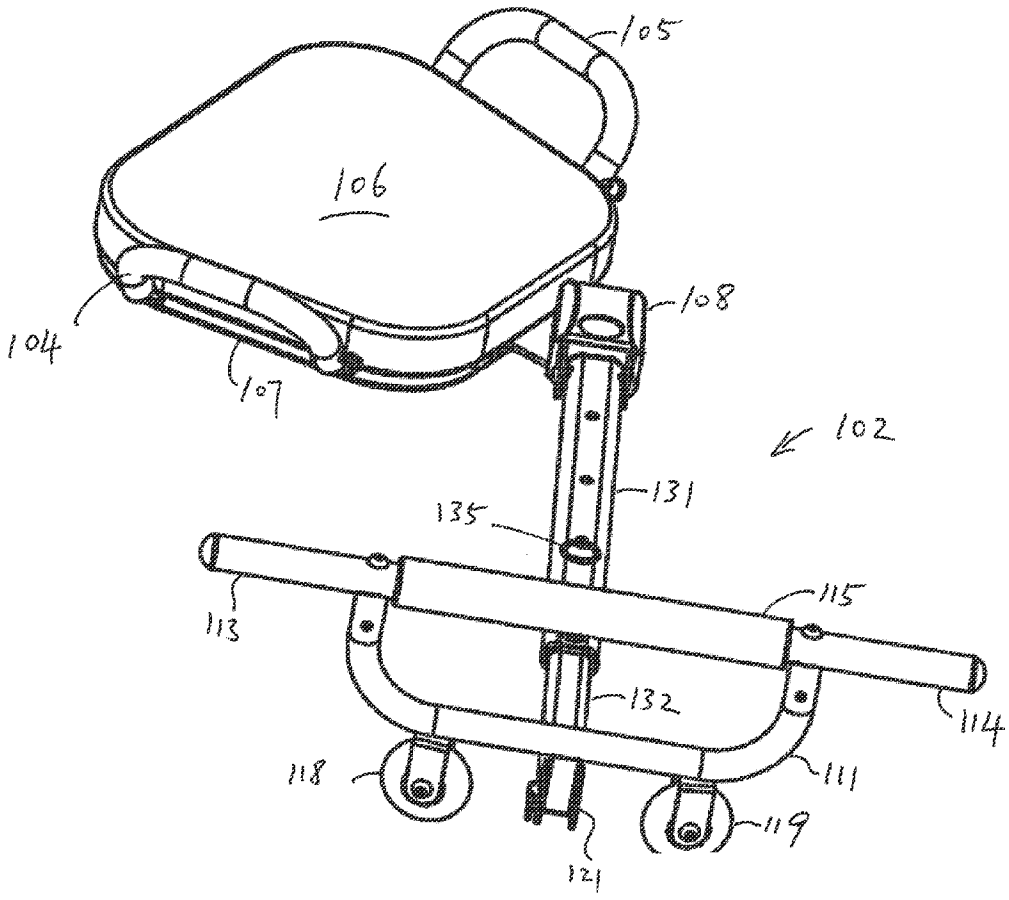
Figure 8C:
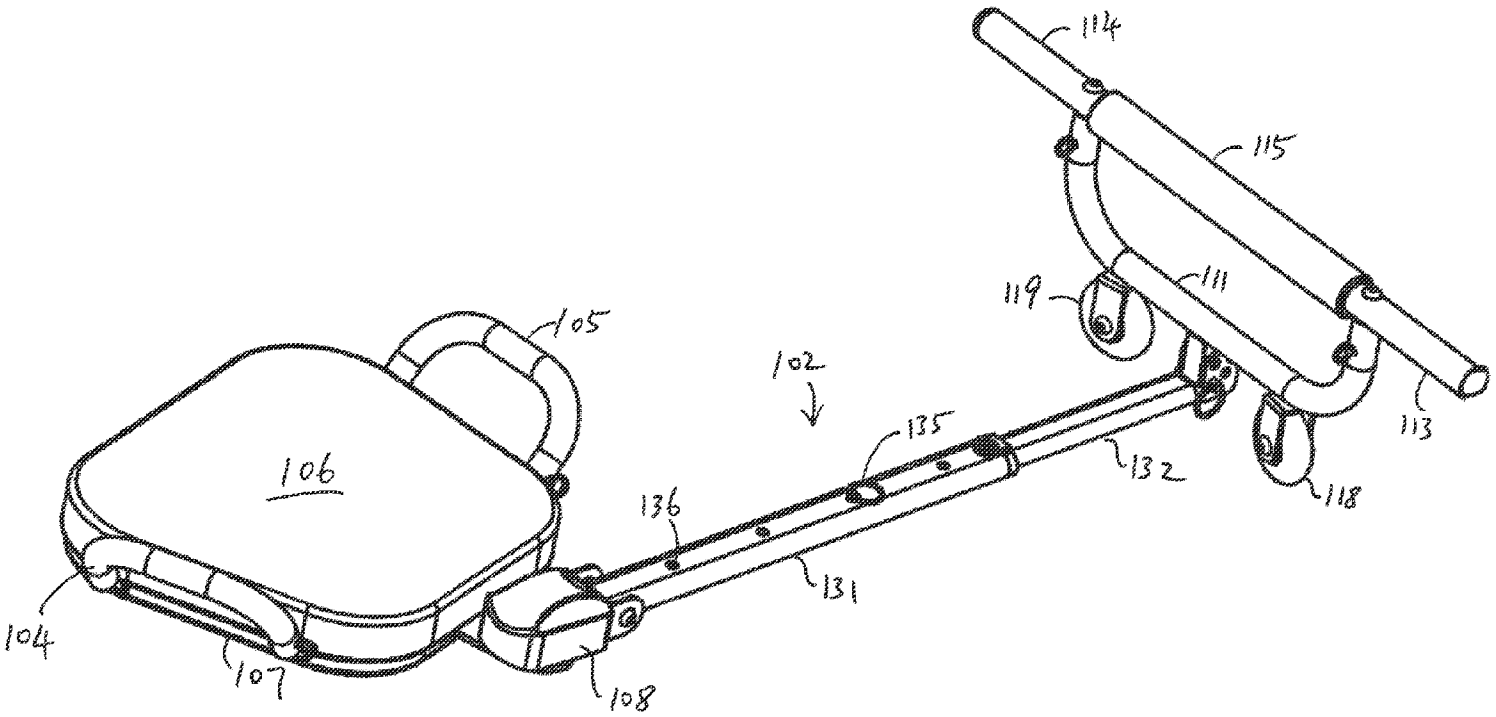
Figure 9:
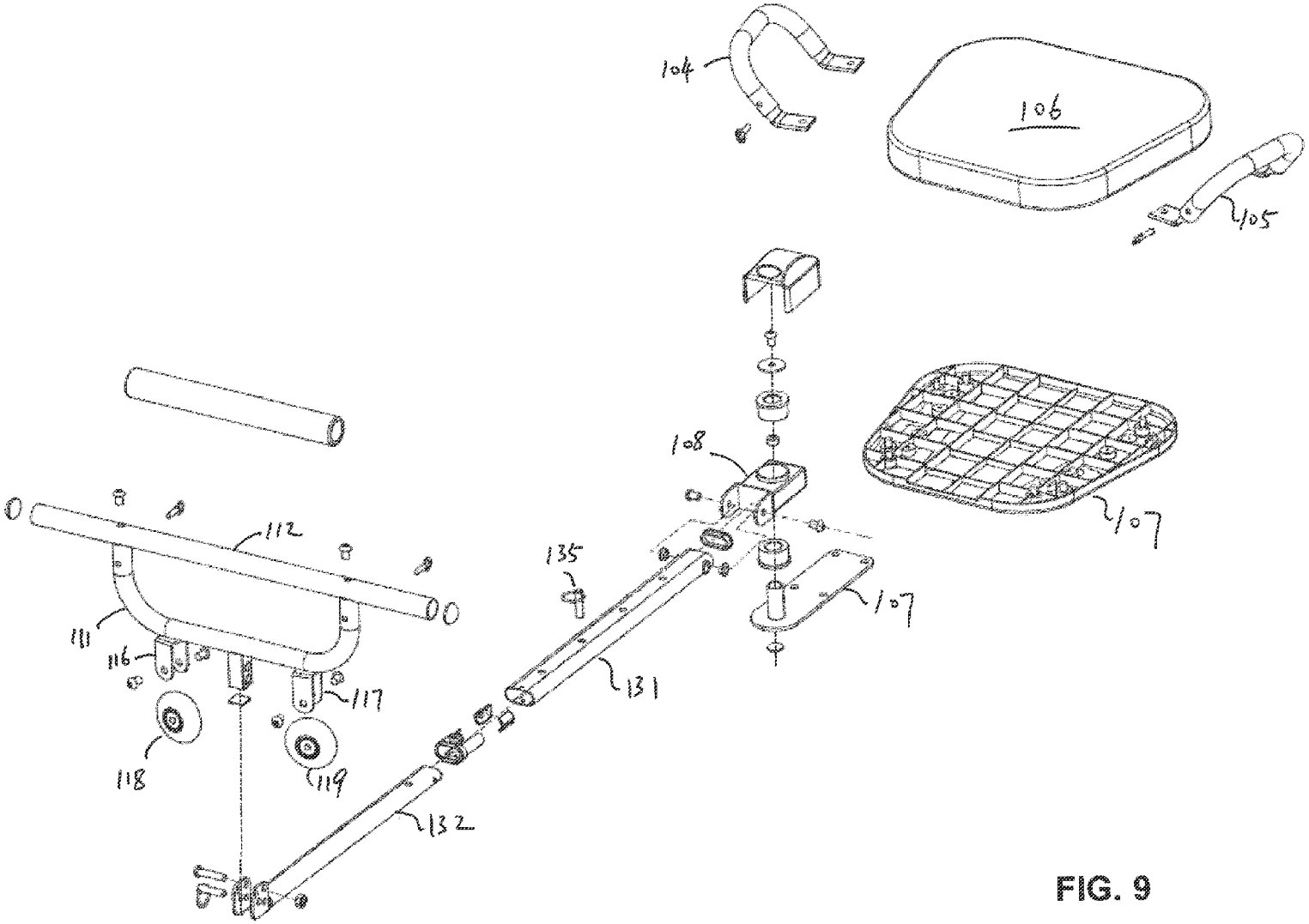
FIG. 9 shows an explosive view of an exercise device according to one embodiment of the invention.

Referring now to FIGS. 8B-8C, according to one embodiment, elongate member 102 includes a first elongate section 131 and a second elongate section 132. Elongate section 131 includes a first end (or near end) coupled to mounting bracket 108 of base frame 101 and a second end (or far end) coupled to a first end of elongate section 132. Second end of elongate section 132 is mounted on mounting bracket 121 of moveable frame 103. In one embodiment, elongate section 131 is a tubular section that allows elongate section 132 to extend from and retract into the cross section or tube of elongate section 131 to reach a desirable length of elongate member 102, for example, dependent upon how tall the user is.

In one embodiment, each of elongate sections 131-132 includes an array of locking holes (e.g., locking hole 136) disposed thereon. The locking holes can be aligned to interlock elongate sections 131-132 using a locking pin 135 inserted into a pair of aligned locking holes. Each of locking holes of elongate section 131 can be aligned with any of locking holes of elongate section 132 to adjust the length of overall elongate member 102.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An exercise device, comprising:

a base frame having a base plate, a base pad mounted on the base plate, a first handle mounted on a first side of the base plate, and a second handle mounted on a second side of the base plate, wherein the base frame further comprises a first mounting bracket mounted on a mounting plate extended from the base plate via a first hinge to allow the first mounting bracket to swing horizontally with respect to the mounting plate;

a movable frame having a second mounting bracket mounted disposed thereon; and an elongate member coupling the base frame and the moveable frame, wherein the elongate member comprises a first end rotatably coupled to the first mounting bracket of the base frame via a second hinge to allow the elongate member to swing up and down vertically with respect to the base plate, and wherein the elongate member further comprises a second end fixedly coupled to the second mounting bracket of the moveable frame to allow the moveable frame to swing left and right horizontally with respect to the base frame via the first hinge, while swinging vertically with respect to the base frame via the second hinge, wherein the moveable frame is configured to swing vertically or horizontally while the base frame remains steady at a fixed location.

2. The exercise device of claim 1, wherein the first handle and the second handle of the base frame are configured to be grasped by hands of a user while the user is sitting on the base pad and placing a foot of the user on the movable frame during usage of the exercise device.

3. The exercise device of claim 1, wherein the second hinge allows the base frame, the moveable frame, and the elongate member to position in a substantially flat configuration supported by a substantially flat structure.

4. The exercise device of claim 1, wherein the baes frame can be placed on a raised platform while the elongate member and the moveable frame are extended outwardly and downwardly via the second hinge to allow a user to site on the base pad while placing a foot of the user on the moveable frame at a position lower than the base frame.

5. The exercise device of claim 1, wherein the moveable frame comprises:

a lateral bar; and a U-shape bar having a first end and a second end coupled to the lateral bar to form a first send section, a second end section, and a center section of the lateral bar.

6. The exercise device of claim 5, further comprising:

a first hook disposed on the first handle of the base frame;

a second hook disposed on the second handle of the base frame;

a third hook disposed on the first end of the U-shape bar; and a fourth hook disposed on the second end of the U-shape bar, wherein the first hook and the third hook can be utilized to connect a first elastic cord member, and wherein the second hook and the fourth hook can be utilized to connect a second elastic cord member to provide additional resistance.

7. The exercise device of claim 5, wherein the device is configured to allow a first foot of the user to be placed on the first end section of the lateral bar and a second foot of the user to be placed on the second end section of the lateral bar, and wherein the center section of the lateral bar is of sufficient length to allow both the first foot and second foot of the user to be placed between the center section of the lateral bar and the U-shape bar.

8. The exercise device of claim 5, wherein the first end section and the second end section of the lateral bar of the moveable frame are configured to be grasped by hands of the user, while knees of the user are placed on the base pad of the base frame.

9. The exercise device of claim 1, further comprising:

a first wheel mounting bracket having a first wheel mounted therein; and a second wheel mounting bracket having a second wheel mounted therein, wherein the first wheel mounting bracket and the second wheel mounting bracket are mounted at a bottom of the moveable frame to support and provide a smooth transaction for the moveable frame when the moveable frame horizontally swings with respect to the base frame.

10. The exercise device of claim 9, wherein each of the first wheel mounting bracket and the second wheel mounting bracket are loosely mounted on the moveable frame via a pair of screws, such that a direction of the first wheel and the second wheel changes in response to a swing movement direction of the moveable frame.

11. The exercise device of claim 9, wherein the first wheel mounting bracket and the second wheel mounting bracket are mounted on a center portion of the U-shape bar.

12. The exercise device of claim 1, wherein the elongate member comprises:

a first elongate section having the first end coupled to the base frame; and a second elongate section having the second end coupled to the moveable frame, wherein the second elongate section is extendable from the first elongate section with a plurality of extended lengths.

13. The exercise device of claim 12, wherein the first elongate section comprises a first set of holes and the second elongate section comprises a second set of holes, and wherein each of the first set of holes can be aligned with any of the second set of holes to lock any of the extended lengths using a locking pin inserted through a pair of aligned holes.

* * * * *